US006688396B2

(12) United States Patent
Floerke et al.

(10) Patent No.: US 6,688,396 B2
(45) Date of Patent: Feb. 10, 2004

(54) INTEGRATED MODULAR CONNECTOR IN A DRILL PIPE

(75) Inventors: Helmut Floerke, Celle (DE); Detlef Ragnitz, Dassel-Markoldendorf (DE); Johannes Witte, Braunschweig (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/007,751

(22) Filed: Nov. 8, 2001

(65) Prior Publication Data

US 2002/0112852 A1 Aug. 22, 2002

Related U.S. Application Data

(60) Provisional application No. 60/247,092, filed on Nov. 10, 2000.

(51) Int. Cl.[7] ..... E21B 17/02

(52) U.S. Cl. ..... 166/380; 166/65.1; 166/242.6; 175/40

(58) Field of Search ..... 166/380, 244.1, 166/65.1, 242.6, 242.1; 175/40, 57, 320, 104; 285/333; 174/47, 84 S; 340/854.3, 854.4, 855.1, 855.2, 855.8; 439/191, 194, 195, 207, 208, 210; 138/155; 200/61.6

(56) References Cited

U.S. PATENT DOCUMENTS

| | | | | |
|---|---|---|---|---|
| 2,178,931 A | | 11/1939 | Crites et al. | 439/191 |
| 3,170,137 A | | 2/1965 | Brandt | 340/855.1 |
| 3,253,245 A | | 5/1966 | Brandt | 439/191 |
| 3,518,608 A | | 6/1970 | Papadopoulos | 439/191 |
| 3,518,609 A | | 6/1970 | Fontenot, Jr. | 439/191 |
| 3,879,097 A | | 4/1975 | Oertle | 340/855.1 |
| 4,537,457 A | | 8/1985 | Davis, Jr. et al. | 439/190 |
| 4,676,563 A | | 6/1987 | Curlett et al. | 439/194 |
| 4,690,212 A | * | 9/1987 | Termohlen | 166/65.1 |
| 4,799,544 A | | 1/1989 | Curlett | 166/65.1 |
| 4,806,115 A | | 2/1989 | Chevalier et al. | 439/194 |
| 5,334,801 A | | 8/1994 | Mohn | 174/47 |
| 6,019,182 A | | 2/2000 | Rountree et al. | 175/325.2 |
| 6,050,131 A | | 4/2000 | Willauer | 73/37 |
| 6,367,564 B1 | * | 4/2002 | Mills et al. | 175/40 |

FOREIGN PATENT DOCUMENTS

| | | |
|---|---|---|
| GB | 2361113 A | 10/2001 |
| WO | WO01/21932 A1 | 3/2001 |
| WO | WO02/06716 A1 | 1/2002 |

* cited by examiner

*Primary Examiner*—David Bagnell
*Assistant Examiner*—Matthew J Smith
(74) *Attorney, Agent, or Firm*—Madan, Mossman & Sriram, P.C.

(57) ABSTRACT

An apparatus is provided for conveying electrical power and data signals between a first location and a second location in a well borehole. The apparatus comprises a first drill pipe disposed at the first location, and a second drill pipe disposed at the second location. A second end of the second drill pipe is coupled to a first end of the first drill pipe. A first plurality of conductive pathways such as insulated wires extend longitudinally through at least a portion of the first drill pipe and terminate at the first end. A second plurality of conductive pathways extend longitudinally through at least a portion of the second drill pipe and terminate at the second end. A verification device is operatively associated with the first and second pluralities of conductive pathways for verifying electrical continuity between the first and second pluralities of conductive pathways.

19 Claims, 5 Drawing Sheets

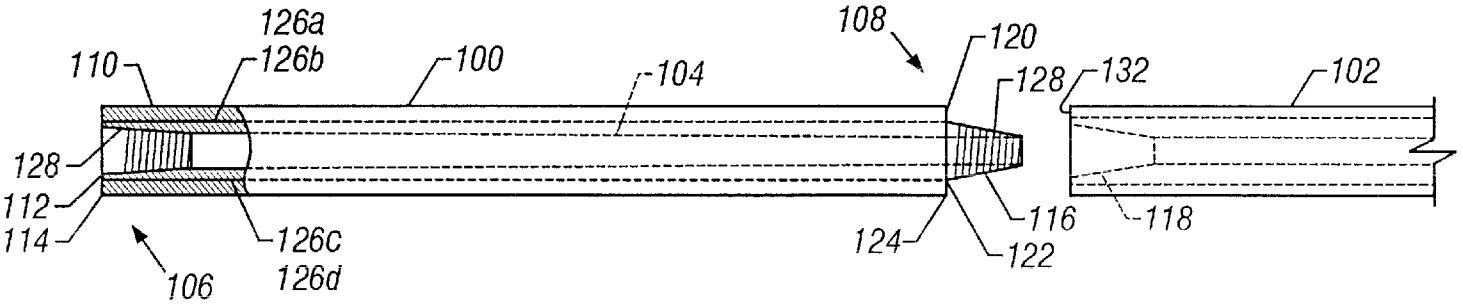
FIG. 1A
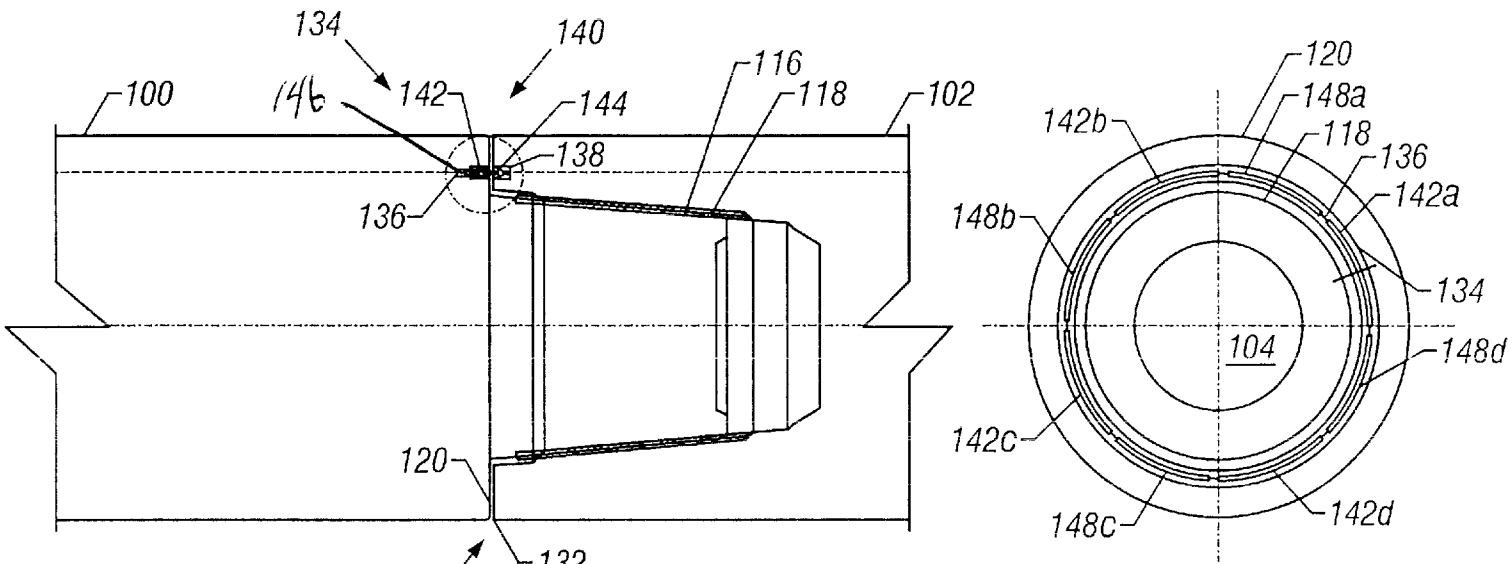
FIG. 1B
FIG. 1C

INTEGRATED MODULAR CONNECTOR IN A DRILL PIPE

RELATED APPLICATION

This application is related to a U.S. provisional application titled "Integrated Modular Connector in a Drill Pipe" filed on Nov. 10, 2000, serial No. 60/247,092, the entire specification of which is hereby incorporated herein by reference and from which priority is claimed for the present application.

BACKGROUND OF THE INVENTION

1. Field of the Invention

This invention relates generally to oil well tools, and more particularly drill pipe electrical connectors for rig site applications.

2. Description of the Related Art

In the oil and gas industry, hydrocarbons are recovered from formations containing oil and gas by drilling a well borehole into the formation using a drilling system. The system typically comprises a drill bit carried at an end of a drill string. The drill string is comprised of a tubing which may be drill pipe made of jointed sections or a continuous coiled tubing and a drilling assembly that has a drill bit at its bottom end. The drilling assembly is attached to the bottom end of the tubing. To drill a borehole, a mud motor carried by the drilling assembly rotates the drill bit, or the bit is coupled to drill pipe, which is rotated by surface motors. A drilling fluid, also referred to as mud, is pumped under pressure from a source at the surface (mud pit) through the tubing to, among other things, drive the drilling motor (when used) and provide lubrication to various elements of the drill string.

For many years drilling operations have included instrumentation disposed in one or more jointed pipe sections called a bottom-hole assembly (BHA) near the drill bit to measure various characteristics of the formation, the borehole and the drill string. These measurements are called measurement while drilling (MWD) or logging while drilling (LWD). Measurements from MWD and LWD include formation pressure, properties of hydrocarbons trapped in the formation, temperature and pressure of annulus fluids, drill bit direction, rotational speed and azimuth.

Instruments housed in the BHA and used for the various measurements typically are powered by downhole generators located somewhere along the drill string, and signals from sensors are typically transferred to a mud-pulse telemetry subsystem also located along the drill string. These various components are usually electrically interconnected with insulated wiring also housed within the drill string.

A particular difficult problem exists when wires must traverse more than one joint of a drill string. Achieving and maintaining a reliable electrical bond between pipe joints is very difficult considering the harsh environments encountered downhole, rugged handling of cumbersome pipe joints and time constraints placed on drilling operators at the surface. Prior art devices such as those described in U.S. Pat. No. 3,696,332 to Dickson, Jr. et al., and U.S. Pat. No. 5,251,708 to Perry et al. have tackled this problem using a ring connector with a single and substantially circular contact disposed at opposite ends of a pipe joint. These modular ring connectors are electrically connected together by a bus or wire in the pipe joint. When one pipe joint is connected to the next, a contact ring disposed on each of the mating modular ring connectors electrically mates with a like contact ring disposed a mating pipe or BHA sub thereby establishing an electrical path through the coupled pipe joints or between a pipe joint and BHA sub.

Data acquisition in more recent MWD and LWD devices is becoming more and more sophisticated, and requires more and more power, bandwidth and channels. One of the drawbacks of ring connectors such as those described above is that a single contact and associated bus or wire is a limiting factor on the usefulness of instrumentation used today. Therefore, a need exists to provide a modular ring connector that has multiple contacts and multiple path wiring integrated into a drill pipe and the various BHA subs attachable thereto. Also, in providing an improved modular ring connector having multiple contacts, a further need exists to verify that the multiple contacts and associated conductors are mated properly.

SUMMARY OF THE INVENTION

The present invention addresses the drawbacks discussed above by providing a drilling apparatus and method for transmitting an electrical signal between an uphole location and a downhole location using modular electrical connectors having multiple contacts and multiple wiring pathways integral to a drill string pipe joint.

An apparatus is provided for conveying electrical power and data signals between a first location and a second location in a well borehole. The apparatus comprises a first drill pipe disposed at the first location, and a second drill pipe disposed at the second location. A second end of the second drill pipe is coupled to a first end of the first drill pipe. A first plurality of conductive pathways such as insulated wires extend longitudinally through at least a portion of the first drill pipe and terminate at the first end. A second plurality of conductive pathways extend longitudinally through at least a portion of the second drill pipe and terminate at the second end. A verification device is operatively associated with the first and second pluralities of conductive pathways for verifying electrical continuity between the first and second pluralities of conductive pathways.

The present invention also provides a method for conveying electrical power and data signals between a first location and a second location in a well borehole via multiple conductive pathways. The method comprises coupling a first end of a first drill pipe to a second end of a second drill pipe. The two pipes are conveyed such that the first drill pipe is conveyed to the first location and the second drill pipe is conveyed to the second location. The first and second drill pipes have corresponding pluralities of conductive pathways extending longitudinally through at least a portion of each drill pipe and terminating respectively at the first and second ends. The method provides for verifying electrical continuity between the first and second pluralities of conductive pathways with a verification device operatively associated with the first and second pluralities of conductive pathways to ensure the pathways are electrically connected.

A modular ring connector provided by the present invention connects multiple independent electrical wireways upon coupling of pipe joints or of a pipe joint and BHA sub. The ring connectors may include four segments made of conductive material, and with segments centers at an angle of 45°. Segments made of non conductive material are disposed between the conductive segments, and the nonconductive segments also have centers at an angle of 45°.

The alignment of conductive segments or contacts may be accomplished by various embodiment options including time cut thread, ring alignment and electrical selection. A time cut embodiment includes a pipe joint and/or a BHA sub having all threads of a pin and/or box end with modular connector cut to precise specifications. The multiple contacts on the connector ring will then always align when the threads are connected to a like-threaded connector.

A ring alignment embodiment includes an alignment gauge. During assembly of the modular ring the position of the thread to the shoulder will be measured by the gauge. The gauge will show the correct position of the segments, and when assembled into the sub, the ring will be positioned with respect to this measured position.

The third and most viable option is electrical selection where the segments are aligned by an electrical switching device. When the system is powered, the electronics will automatically measure the position of each independent modular ring at each thread and will align the contacted wires according to the measurement.

BRIEF DESCRIPTION OF THE DRAWINGS

For detailed understanding of the present invention, references should be made to the following detailed description of the preferred embodiment, taken in conjunction with the accompanying drawings described below, in which like elements have been given like numerals.

FIG. 1A is a plan view of a drill pipe joint 100 with a box end cross-sectioned and partial plan view of a second pipe joint 102.

FIG. 1C is an end view of the lower end of the first pipe of FIG. 1B.

DESCRIPTION OF THE PREFERRED EMBODIMENTS

Figure 2A:
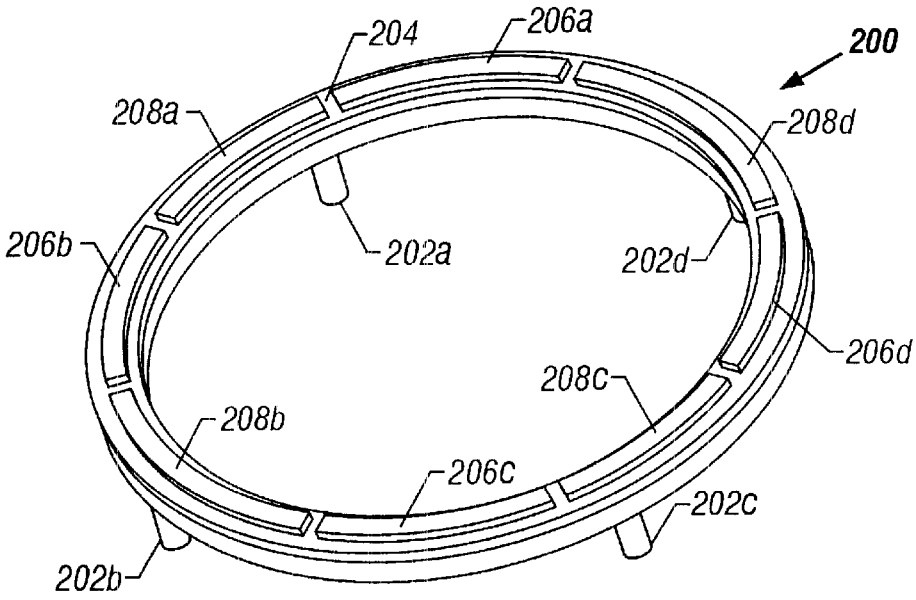
FIG. 2A is an isometric view of a ring assembly according to the present invention showing multiple contacts.

FIG. 1A is a plan view of a drill pipe joint 100 with a box end cross-sectioned and partial plan view of a second pipe joint 102. The first drill pipe 100 has a central bore 104 extending from a first or upper end 106 to a second or lower end 108. The upper end 106 has an internally threaded box 110. The box 110 is usually tapered and has an end shoulder 112 extending from the box inner edge to the outer edge 114 of the pipe. The lower end 108 has an externally threaded pin 116 tapered and threaded to mate with a second pipe 102 having a box 118 substantially identical to the box 110 of the first pipe 100. The pin 116 has a base shoulder 120 extending from the threaded edge 122 to the outer edge of the pipe 124. A plurality of insulated wires 126*a,* 126*b,* 126*c,* etc. are integrally disposed within the pipe to make an electrically conductive pathway between the pin base shoulder 120 to the box end shoulder 112. Electrical contacts are disposed at each of the shoulders 120 and 112 to receive the electrical wires. The pin 116 and box 110 typically have threads 128 conforming to American Petroleum Institute (API) standards. Whatever thread standard is used, the threads must be compatible for proper mating. The pipes are typically produced substantially identical to each other to allow interchangeability between pipes. Thus, the second pipe may have a pinned end to mate with a cupped end of the first pipe. Furthermore, the lengths of pipe may vary between joints without adversely affecting the mating.

Figure 1B:
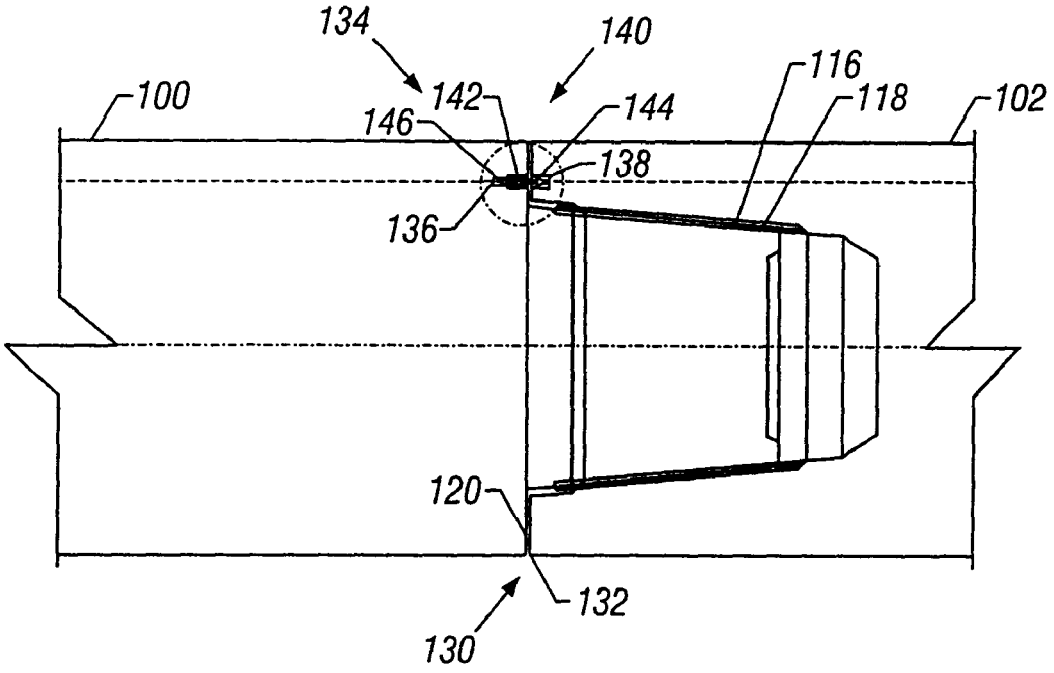
FIG. 1B is an enlarged view of mated pipes such as in FIG. 1A.
Figure 3B:
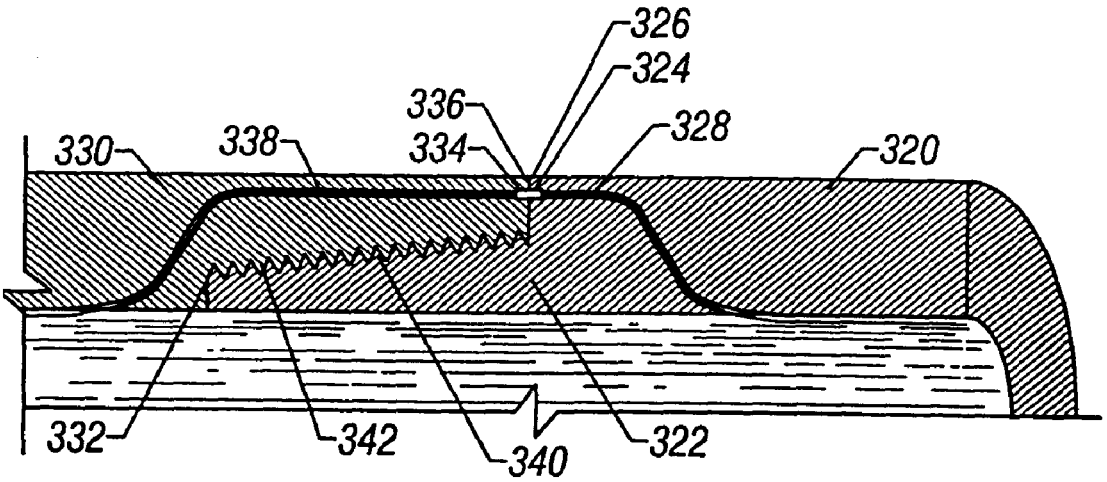

FIG. 1B is an enlarged view of mated pipe joints such as in FIG. 1A. The first pipe 100 is mated to the second pipe 102 at a coupling 130 with an externally threaded pin 116 screwed into a complementary internally threaded box 118. A base shoulder 120 on the first pipe 100 is juxtaposed to an end shoulder 132 on the second pipe 102 when the two pipes are fully mated. Each shoulder includes a ring assembly 134 and 140 extending in a circular path around a central axis of the pipe.

Multiple electrically conductive contacts 142 are disposed in a groove 136 on the ring assembly of the first pipe 100. A similar groove 138 in a similar ring assembly 140 of the second pipe 102 has a corresponding contact 144 for each contact 142 on the first pipe. The contacts may be any suitable conductive material and the preferred material is gold-plated copper berrillium. A spring 146 associated with each contact on each pipe provides force to ensure each contact from the first pipe remains electrically connected to its mated contact on the second pipe.

FIG. 1C is an end view of the lower end of the first pipe of FIG. 1B. The base shoulder 120 extends around the pin 118, and the central bore 104 is at the center of the pipe. The groove 136 is shown disposed in the ring assembly 134, and the contacts 142*a,* 142*b,* 142*c* and 142*d* are mounted in the groove and separated by high-temperature polymide inserts 148*a,* 148*b,* 148*c* and 148*d* to protect and insulate the contacts from each other. The preferred insulating insert is polyetheretherketone, commonly known by the acronym PEEK, although Arlon is another known material found suitable for this invention.

FIG. 2A is an isometric view of a ring assembly 200 according to the present invention showing contacts and insulating inserts alternatingly disposed in the ring assembly. The ring assembly 200 is attached to a drill pipe (not shown) via suitable fasteners such as press-fit dowel pins 202*a,* 202*b,* 202*c,* and 202*d.* The ring may also be fastened to the drill pipe shoulder by screws, epoxy, keeper ring, by having a thread on the inner diameter to mate with a male fitting, a thread on the outer diameter to mate with a female fitting, and/or by welding or soldering.

It should be noted here that the groove 204 might be cut directly into the shoulder of the drill pipe. In this case, the ring assembly 200 is not necessary. The ring assembly provides the added benefit of maintainability when contacts become worn or broken.

Still referring to FIG. 2A, contacts 206*a,* 206*b,* 206*c* and 206*d* are disposed at 45 angles with PEEK inserts 208*a,* 208*b,* 208*c* and 208*d* disposed at 45. Angles and between the contacts. The length of each contact arc along with the length of the PEEK inserts spacing the contacts apart allow for proper connection with a similar mating ring assembly with a substantial safety margin to ensure contacts are not misaligned. More contacts in the assembly will reduce the available safety margin by requiring a reduction of the contact length, spacing between contacts or both. Reducing the number of contacts will provide the ability to increase the margin of safety by allowing for larger contact size, more space between contacts or both.

Figure 2B:
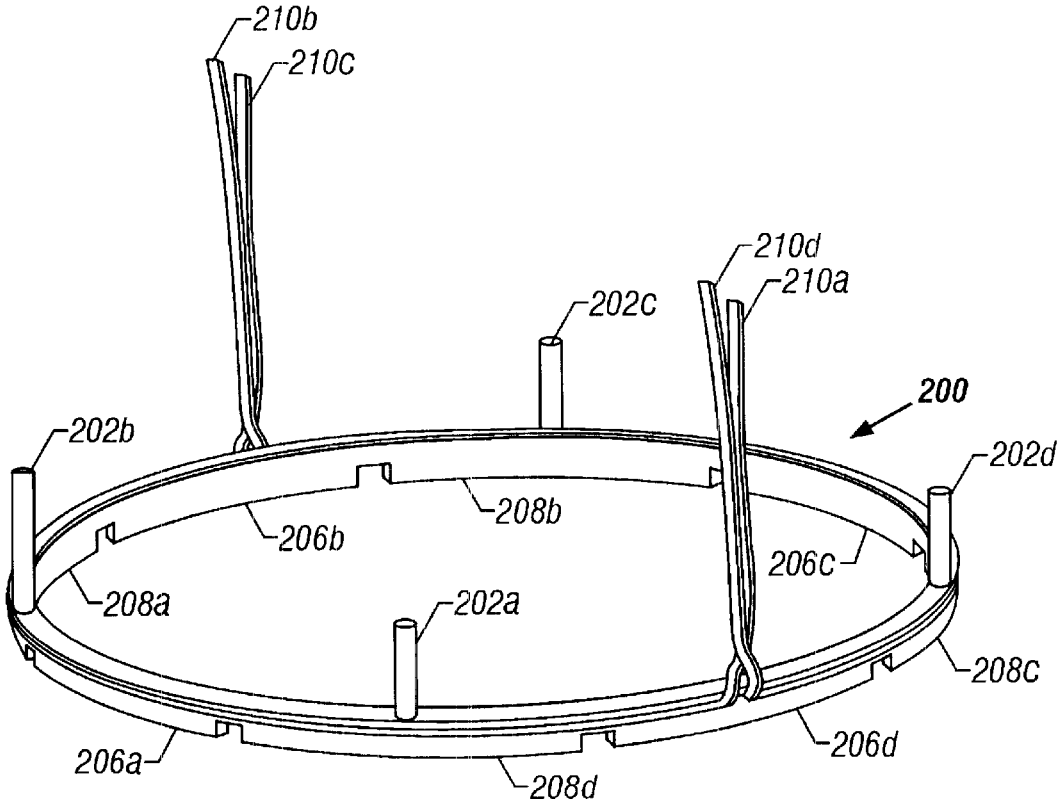
FIG. 2B is an isometric view of the ring assembly of FIG. 2A shown from another angle.

FIG. 2B is an isometric view of the ring assembly 200 of FIG. 2A from another angle. In this view, the fasteners 202*a*14 202*d* are shown extending upward, which would be toward a pipe shoulder (not shown) on which the ring assembly would be anchored. Each contact 206*a*–206*d* has an associated conductor 210*a*–210*d* leading from the contact. The conductor is preferably an insulated wire having a current and voltage rating suitable for a particular desired application. Each wire is conductively bonded to its associated contact by typical known methods such as soldering or wire-wrap. Leading from the contact, each wire extends to the opposite end of the drill pipe, and as described above and shown in FIG. 1A, each wire passes through a conduit or wire groove cut into the pipe.

Figure 3A:
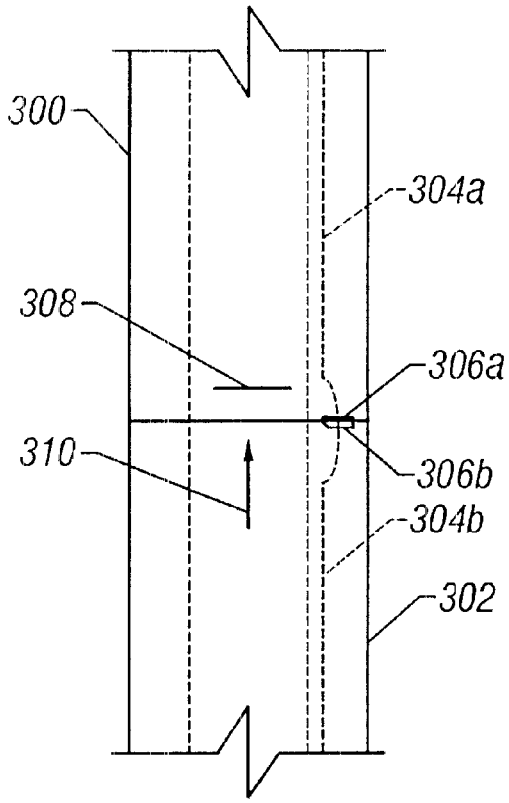
FIG. 3A is a plan view of a coupled pair of drill pipe joint sections.
Figure 3B:
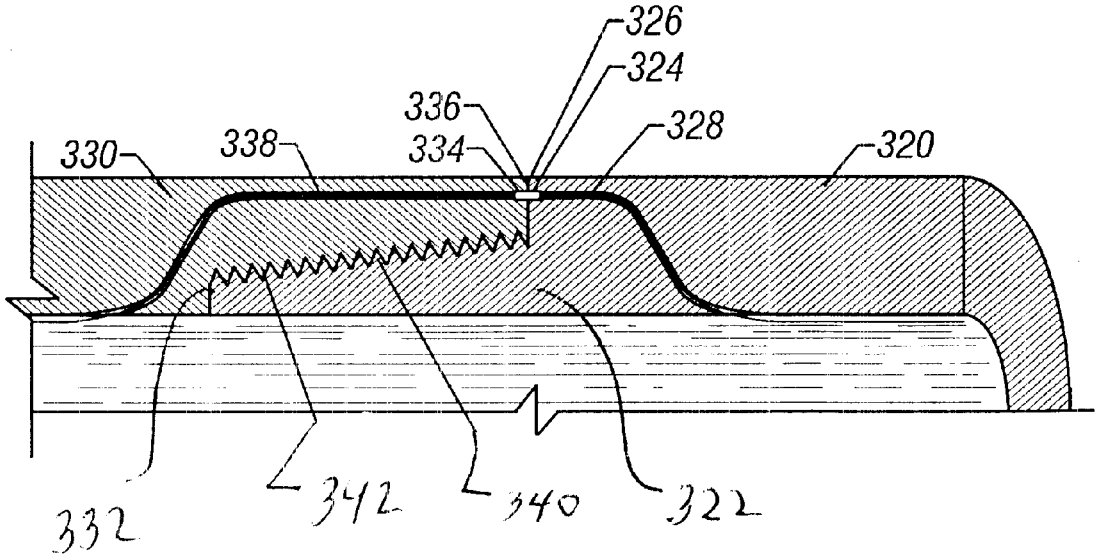
FIG. 3B is a cross-section view of a coupled pair of drill pipe joint sections according to another embodiment of the present invention.
Figure 3C:
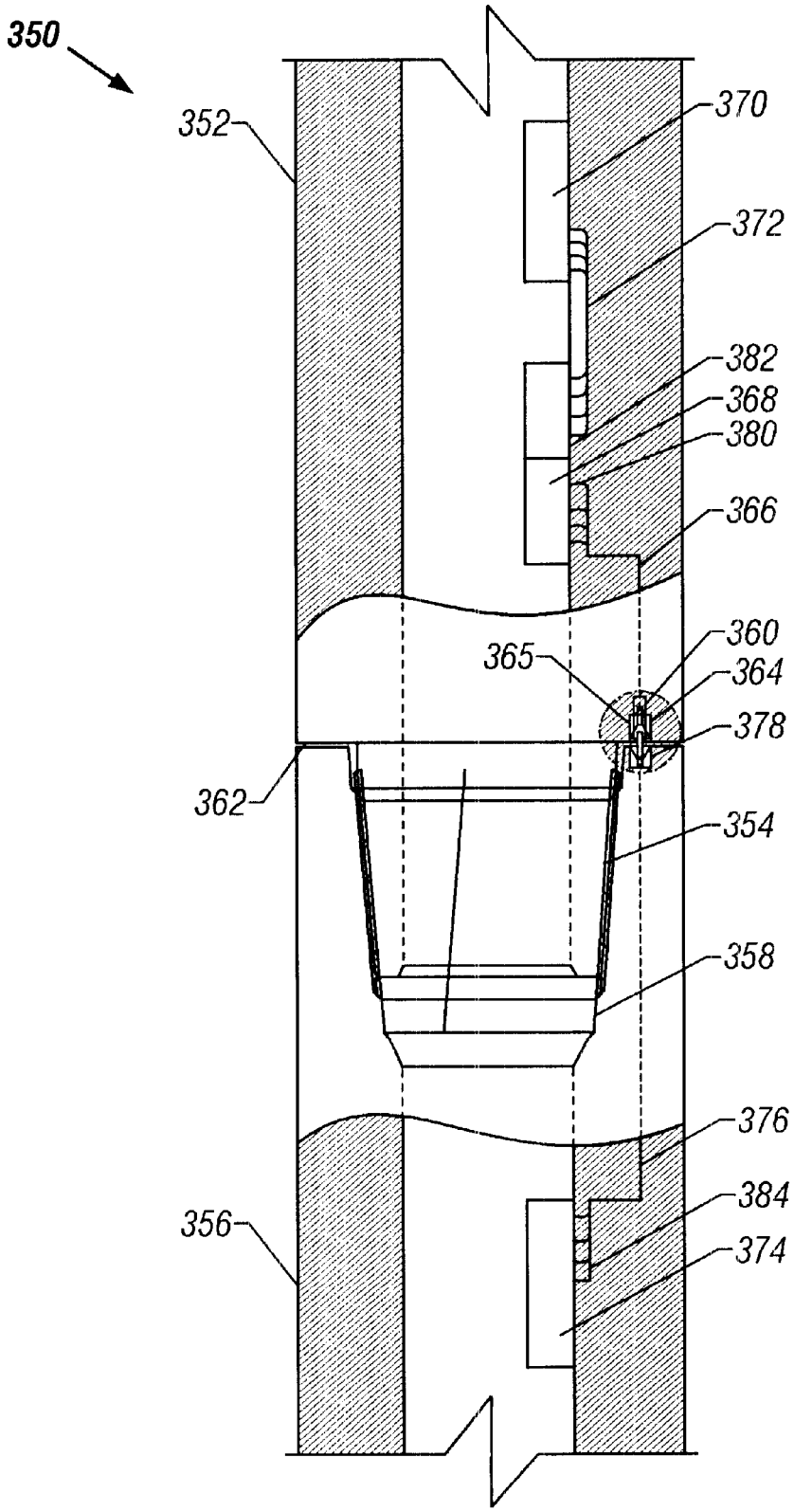
FIG. 3C is a cross-sectioned elevation view of another embodiment of the present invention showing a section of drill string.

Referring now to FIGS. 3A through 3C, three embodiments of the present invention for verifying and ensuring proper connection will be described. FIG. 3A is a plan view of a coupled pair of drill pipe joint sections 300 and 302. Each pipe joint has a ring assembly (not shown) as described above and shown in FIGS. 2A and 2B. Each ring assembly has a plurality of contacts, and each contact is attached to a wire that extends through the respective pipe as described and shown above. For simplicity, only a single conducting wire 304*a* and 304*b* and single contact pair 306*a* and 306*b* are shown in each pipe.

The contacts 306*a* and 306*b* must align properly so that current will flow across the contact junction and through the conductors 304*a* and 304*b*. Furthermore, a circuit configuration of instruments in a tool (not shown) housed in the drill string typically requires that specific contacts be mated together. Therefore, a mechanical alignment gauge comprising an indicator 308 stamped, engraved or painted on one pipe 300, and a corresponding indicator 310 similarly disposed on the joining pipe 302. A very simple, yet effective indicator pair is shown in FIG. 3A. The indicator 308 for the first pipe 300 is a longitudinal line or bar marking, while the indicator 310 on the joining pipe 302 is a vertical arrow or line.

The length of the line 308 is proportional to the length of each contact 306*a* or the line may be proportional to the distance between contacts. The arrow 310 is located on the second pipe 302 such that each contact 306*b* on that pipe aligns with a corresponding contact 306*a* on the first pipe 300 whenever the arrow 310 aligns with any portion of the line 308. This alignment feature will ensure that the same pair of contacts 306*a* and 306*b* are mated every time the two pipes 300 and 302 are joined. Any variation due to wear or thread deformation is taken into account when defining the length of contacts, space between contacts and the length of the horizontal indicator line 308.

The embodiment shown in FIG. 3A is a mechanical configuration of an indicator used when pipe joints are mated at the surface by a drilling crew. The intent of the present invention is to also include non-mechanical indicators for use by the drilling crew to assure contacts are properly mated. A not-shown electrical embodiment includes a typical multimeter adapted for measuring contact alignment and/or continuity. The multimeter is preferably located at the surface and should be accessible to the drilling crew. A crew member attaches the multimeter at the contacts exposed at a distal end of the drill pipe being joined, and a meter indicator such as a continuity light or audible signal provides confirmation that contacts are mated when the piped are joined.

FIG. 3B is a cross section view of a coupled pipe pair according to another embodiment of the present invention. A first pipe joint 320 includes a pin 322 and a ring assembly 324. Multiple contacts 326, one of which is shown are disposed in the ring assembly 324. Each contact 326 is electrically bonded to a corresponding conductor 328, and each conductor extends from the corresponding contact through at least a portion of the second pipe 320. A second pipe joint 330 is shown mated to the first pipe 320. The second pipe has a box 332 and a ring assembly 334. Multiple contacts 336, of which one is shown are disposed in the ring assembly 334. Each contact 336 is electrically bonded to a corresponding conductor 338, and each conductor extends from the corresponding contact through at least a portion of the second pipe 330. These components are substantially identical to the similarly-named components described above and shown in FIGS. 1A through 2B.

The pin 322 includes externally located threads 340 that are compatible with internal threads 342 of the box 332. The threads are time cut, meaning that they are precision cut such that a predetermined number of turns results in precise positioning of the contacts 326 and 336 each time the pipes 320 and 330 are mated. The advantage of this embodiment is that there are no actions required by the drilling crew other than the typical actions associated with mating pipe joints during drilling operations.

FIG. 3C is a cross-section elevation view of another embodiment of the present invention showing a section of drill string 350. An uphole pipe joint 352 having an externally-threaded pin 354 is shown coupled to a downhole pipe joint 356 having an internally threaded box 358. This coupling is as described above and is a typical pipe coupling configuration known in the art.

As described above and shown in FIGS. 1A through 2B, a modular ring assembly 360 is disposed on the uphole pipe joint 352 on a base shoulder 362 at the base of the pin. The ring assembly 360 includes multiple contacts 364 with one contact being shown. The contacts are housed in a groove 365 and have non-conducting inserts (not shown) separating the contacts as described above and shown in FIGS. 1B and 1C. Each contact 364 is connected to one of multiple conductor wires 366 and each wire 366 leads to an electronic switching unit (ESU) 368 to be described in more detail later. A typical downhole controller 370 well known in the art is disposed in the uphole pipe joint 352 at a suitable location. The controller is electrically connected to the ESU 368 via conductor wires 372, each of which should correspond to one of the ESU-to-contact wires 366.

A primary purpose of the controller 370 is to control at least one electronic instrument 374 disposed in the downhole pipe joint 356. In a typical downhole tool having electronic instruments interconnected via wiring conductors, the conductors leading from one instrument such as the controller 370 shown in FIG. 3C must lead to a particular input of a second instrument. Downhole tools such as the prior art described above typically include instruments disposed in two pipe joints are interconnected via a single conductor leading from the first instrument in an uphole pipe joint to a single ring connector contact. A corresponding single ring connector contact in the downhole pipe joint mates with the contact in the uphole ring connector and a conductor leads from the downhole ring connector to an instrument disposed in the downhole pipe joint.

A major advantage of the present invention is realized when, as shown in FIG. 3C, a downhole pipe joint 356 includes an instrument 374 requiring multiple input wires 376. The instrument shown is disposed in the downhole pipe joint 356. Multiple wires 376 lead from the instrument 374 to corresponding multiple contacts 378, of which only one is shown.

When the uphole pipe 352 is coupled to the downhole pipe 356, the contacts 364 in the uphole pipe 352 interface with the contacts 378 disposed in the downhole pipe 356. The ESU 368 includes a measuring device 380 such as an ohm, current or voltage meter that senses the position of the uphole contacts 364 with respect to the downhole contacts 378 once the instrument is activated by typical methods known in the art. There are several circuits known that have the capability of sensing position of contacts. The ESU also includes a switching circuit 382 such as an array of relays or electronic switches. Once the ESU determines the initial position of contacts, the switching circuit reroutes the wiring paths using the switch array so that there is a continuous electrical pathway leading from the uphole electrical device 370, through the ESU 368, crossing the junction of the contacts 364 and 378, and on to predetermined input/out channels 384 of the instrument 374 disposed in the downhole pipe 356.

It should be understood that the downhole pipe shown in FIG. 3C may also be a tool disposed at the end of a drill pipe, the tool having a box connector substantially identical to the box shown in FIG. 3C. The pipes may also be two joint sections of a wireline apparatus having a coupling substantially as described and shown in FIG. 3C.

The coupling configuration described thus far and shown in FIGS. 1A–3C is known as a flush joint connection with male and female threads cut directly into the pipe. This provides the same inner diameter (ID) and outer diameter (OD) clearances at the pipe coupling as in the middle of the pipe joint once lengths are joined. The invention provided herein may also be incorporated in drill pipes with other coupling schemes such as a threaded and coupled (T&C) joint or tool joint. These alternate coupling configurations are well known in the art.

Figure 4A:
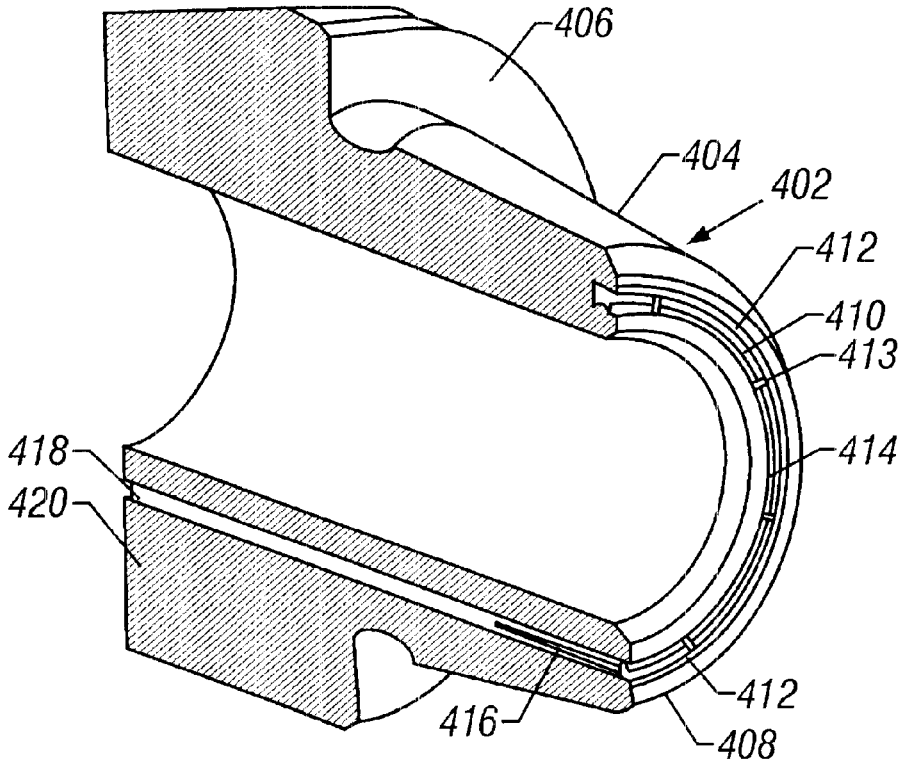
FIGS. 4A and 4B are cross-sectioned isometric views of another embodiment of the present invention showing alternative locations for the ring connectors.
Figure 4B:
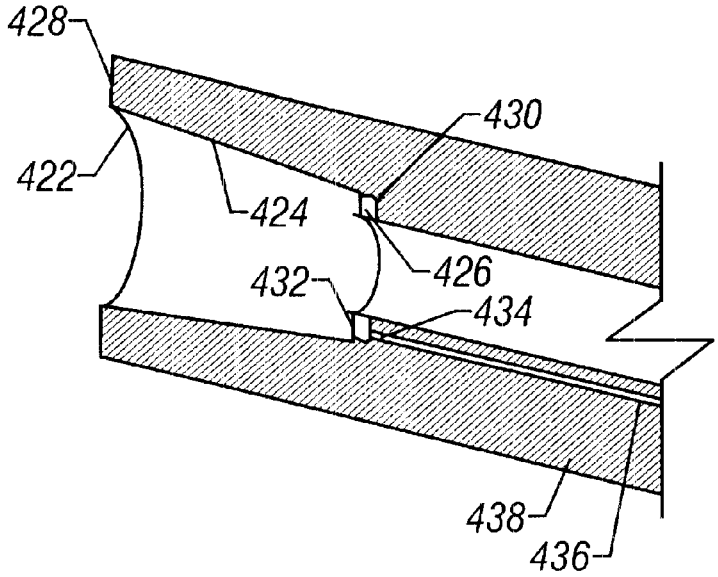

FIGS. 4A and 4B are cross-sectioned isometric views of another embodiment of the present invention showing alternative locations for the ring connectors disposed on a pin and box respectively. The pin 402 has external threads 404 helically disposed around the exterior of the pin and extending from a base shoulder 406 to an end shoulder 408. A modular ring connector 410 having multiple contacts 412 disposed in a ring groove 413 is mounted and anchored on the end shoulder 406 as described above and shown in FIGS. 1B through 2B for a ring connector mounted on a base shoulder. Each contact 412 is separated from the other contacts by a nonconductive insert 414 such as PEEK. A wire 416 is connected to each contact and is routed through a conduit 418 cut in the pipe wall 420.

FIG. 4B is a cross-sectioned isometric view of a box end of a a pipe section capable of mating with the pin 402. The box 422 has internal threads 424 helically disposed around the interior of the box 422 and extending from a base shoulder 426 to an end shoulder 428. When the pin 402 is screwed into the box 422, the pin base shoulder 406 meets the box end shoulder 428. The pin end shoulder 408 housing the pin ring connector meets the box base shoulder 426. A compatible box ring connector 430 is disposed in a groove found in the box base shoulder 426.

The box ring connector is substantially identical to the pin ring connector. The box ring connector 430 includes multiple contacts 432 and a conducting wire 434 for each contact 432 is routed through a conduit 436 extending longitudinally through the pipe wall 438. Suitable high pressure breakout connectors (not shown) well known in the art are used wherever the wires in either pipe must exit the conduit to connect with components such as those described above and shown in FIG. 3C.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An apparatus capable of conveying electrical power and data signals between a first location and a second location in a well borehole, the apparatus comprising:

(a) a first elongated tube disposed at the first location, the first elongated tube having a first end;

(b) a second elongated tube disposed at the second location, the second elongated tube having a second end coupled to the first end;

(c) a first plurality of conductive pathways extending longitudinally through at least a portion of the first elongated tube terminating at the first end;

(d) a second plurality of conductive pathways extending longitudinally through at least a portion of the second elongated tube terminating at the second end; and (e) a verification device operatively associated with the first and second pluralities of conductive pathways for verifying electrical continuity between the first and second pluralities of conductive pathways.

2. The apparatus of claim 1 wherein the first and second elongated tubes are rotatable drill pipes.

3. The apparatus of claim 1 further comprising (i) a first plurality of contacts disposed on the first end, each contact being electrically connected to a corresponding one of the first plurality of conductive pathways;

(ii) a second plurality of contacts disposed on the second end, each of the second plurality of contacts being electrically connected to a corresponding one of the second plurality of conductive pathways.

4. The apparatus of claim 3 further comprising:

(i) a wall defining a shoulder at each of the first and second ends;

(ii) an annular groove in each shoulder, each annular groove housing one of the first and second plurality of contacts; and (iii) an insulating material partially surrounding each of the first and second plurality of contacts.

5. The apparatus of claim 4 wherein each shoulder further comprises:

(i) a ring connector; and (ii) at least one fastener for anchoring the ring connector to the shoulder, wherein the annular grooves are in the ring connectors.

6. The apparatus of claim 5 wherein each at least one fastener is selected from a group consisting of (A) a plurality of dowels secured in corresponding dowel holes located in the walls of each elongated tube, (B) a plurality of screws, (C)a weld joint, and (D) epoxy.

7. The apparatus of claim 1 wherein the verification device is at least one of a mechanical gauge, an electrical meter, and complementary time cut threads disposed on each of the first and second ends.

8. The apparatus of claim 7 wherein the verification device is a mechanical gauge comprising a first symbol disposed on the first end, and a second symbol disposed on the second end, the first and second symbols indicating the first and second pluralities of conductive pathways being electrically mated when the symbols are in a predetermined position relative to each other.

9. The apparatus of claim 1 wherein the first end comprises a pin and the second end comprises a box.

10. The apparatus of claim 1 wherein the verification device further comprises:

(i) a sensor for determining position of each of the first plurality of conductive pathways with respect to at least one of the second plurality of conductive pathways; and (ii) a switch unit for rerouting at least one conductive pathway in at least one of the pluralities of conductive pathways.

11. The apparatus of claim 10 wherein the sensor is selected from a group consisting of (A) an ohm meter, (B) a current meter, and (C) a voltage meter.

12. The apparatus of claim 11 further comprises a processor disposed in the verification device for processing a sensor output.

13. A method for conveying electrical power and data signals between a first location and a second location in a well borehole via multiple conductive pathways, the method comprising:

(a) coupling a first end of an elongated tube having a first plurality of conductive pathways extending longitudinally through at least a portion of the first elongated tube terminating at the first end to a second end of a second elongated tube having a second plurality of conductive pathways extending longitudinally through at least a portion of the second elongated tube terminating at the second end;

(b) verifying electrical continuity between the first and second pluralities of conductive pathways with a verification device operatively associated with the first and second pluralities of conductive pathways.

14. A method according to claim 13 further comprising determining relative position of the first plurality of conductive pathways with respect to the second plurality of conductive pathways.

15. The method of claim 14 wherein the determination is made by using time cut threads disposed on the first end and the second end for coupling the first and second elongated tubes.

16. The method of claim 14 wherein the determination is made by measuring the relative position with a mechanical gauge.

17. The method of claim 16 wherein the mechanical gauge comprises a first symbol and a second symbol, the method further comprising:

(i) disposing the first symbol on the first elongated tube in a location relative to the first plurality of conductive contacts;

(ii) disposing the second symbol on the second elongated tube in a location relative to the second plurality of conductive pathways;

(iii) while performing (a) of claim 13, bringing the second symbol to a position relative to the first symbol, the position being indicative of the first and second pluralities being electrically mated.

18. The method of claim 14 wherein the determination is made by measuring the relative position with an electric meter.

19. The method of claim 14 further comprising rerouting at least one conductive pathway in at least one of the pluralities of conductive pathways with a switching unit.

* * * * *

UNITED STATES PATENT AND TRADEMARK OFFICE

CERTIFICATE OF CORRECTION

PATENT NO. : 6,688,396 B2 
DATED : February 10, 2004
INVENTOR(S) : Helmut Floerke, Detlef Ragnitz and Johannes Witte It is certified that error appears in the above-identified patent and that said Letters Patent is hereby corrected as shown below:

Drawings,
Sheet 1, Fig. 1B, please replace with corrected formal drawing.

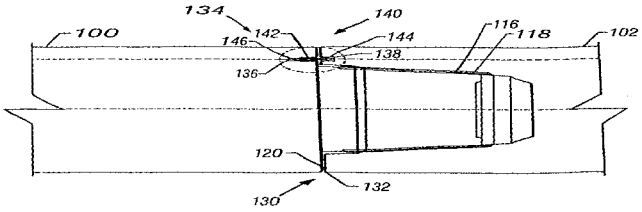

FIG. 1B

Sheet 3, Fig. 3B, please replace with corrected formal drawing.

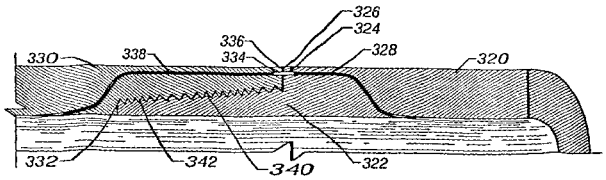

FIG. 3B

Signed and Sealed this

Twenty-fourth Day of August, 2004

Jon W. Dudas

JON W. DUDAS
*Director of the United States Patent and Trademark Office*

UNITED STATES PATENT AND TRADEMARK OFFICE

CERTIFICATE OF CORRECTION

PATENT NO. : 6,688,396 B2 
DATED : February 10, 2004
INVENTOR(S) : Helmut Floerke, Detlef Ragnitz and Johannes Witte It is certified that error appears in the above-identified patent and that said Letters Patent is hereby corrected as shown below:

Drawings,
Please replace informal Sheets 1 and 5, Figs. 1B and 3B, with attached corrected formal drawings.

Signed and Sealed this

Thirty-first Day of August, 2004

JON W. DUDAS
*Director of the United States Patent and Trademark Office*